US005969699A

United States Patent [19]

Balram et al.

[11] Patent Number: 5,969,699

[45] Date of Patent: Oct. 19, 1999

[54] STROKE-TO-STROKE

[75] Inventors: Nikhil Balram, Mountain View; William P. Olson, Fremont; Michael R. Wilson, San Jose, all of Calif.

[73] Assignee: Kaiser Aerospace & Electronics Company, San Jose, Calif.

[21] Appl. No.: 08/885,363

[22] Filed: Jun. 30, 1997

Related U.S. Application Data

[60] Provisional application No. 60/027,946, Oct. 8, 1996.

[51] Int. Cl.[6] ..... G09G 1/10

[52] U.S. Cl. ..... 345/10; 345/16

[58] Field of Search ..... 345/10, 16, 17, 345/136

[56] References Cited

U.S. PATENT DOCUMENTS

| | | | |
|---|---|---|---|
| 3,893,075 | 7/1975 | Orban et al. | 340/172.5 |
| 4,300,136 | 11/1981 | Tsuiki et al. | 340/747 |
| 4,387,365 | 6/1983 | Berry et al. | 340/347 |
| 4,658,248 | 4/1987 | Yu | 340/739 |
| 4,816,814 | 3/1989 | Lumelsky | 340/747 |
| 4,843,480 | 6/1989 | Nishikawa et al. | 358/293 |
| 4,855,935 | 8/1989 | Lien et al. | 364/521 |
| 5,274,307 | 12/1993 | Christensen | 315/368.13 |
| 5,365,251 | 11/1994 | Denbar | 345/136 |
| 5,489,920 | 2/1996 | Kaasila | 345/136 |

*Primary Examiner*—Richard A. Hjerpe
*Assistant Examiner*—Vanel Frenel
*Attorney, Agent, or Firm*—Marvin H. Kleinberg, Esq.; Kleinberg & Lerner, LLP

[57] ABSTRACT

A digital address filter is provided which converts straight-line and arc analog stroke data into digitized images which comply with Bresenham raster display criteria and can be displayed on a raster scanned monitor or LCD. Data collected over a preselected (M pixel×M pixel) spatial window are repetitively matched against a set of pixel template patterns permitted by the Bresenham criteria. After each full-frame iteration, the display pixel(s) corresponding to the best-fit templates are lighted.

41 Claims, 16 Drawing Sheets

| SELECTED OCTANT | MAP ELEMENTS TO BE SAVED |
|---|---|
| 1, 8 | ELEMENTS TO RIGHT OF RH |
| 2, 3 | ELEMENTS BELOW BH |
| 4, 5 | ELEMENTS TO LEFT OF LH |
| 6, 7 | ELEMENTS ABOVE TH |

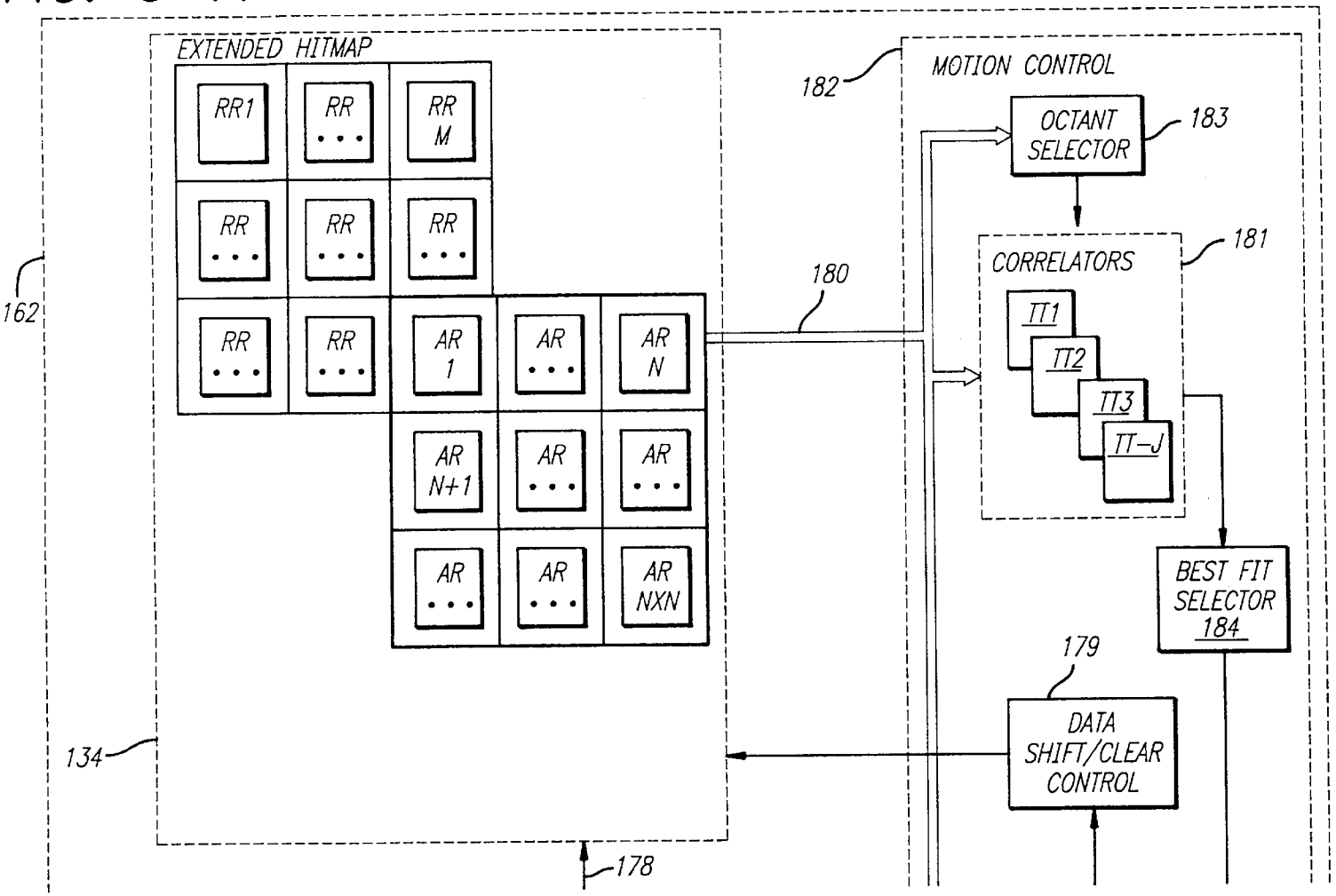
FIG. 9-A

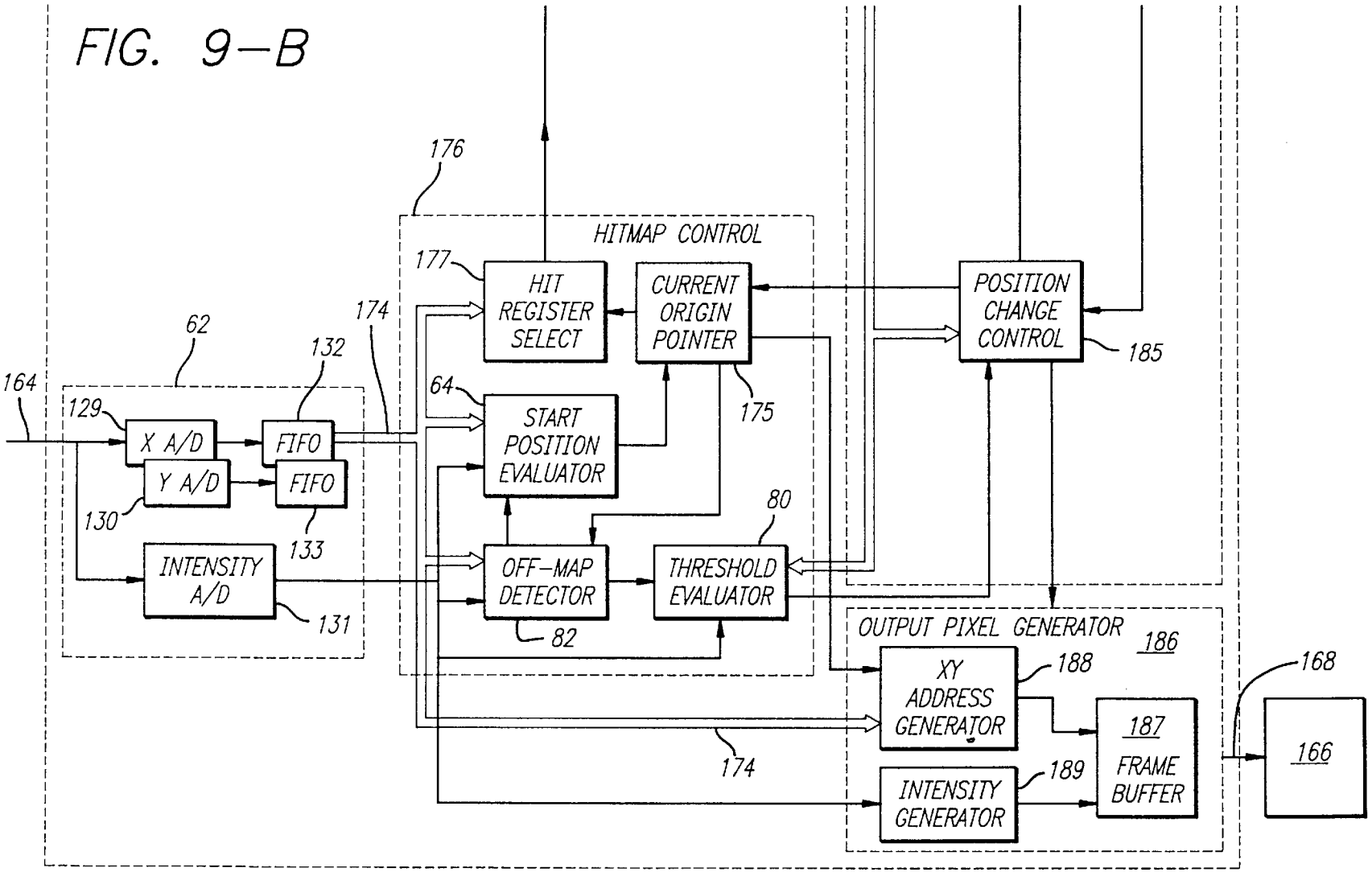
FIG. 9–B

FIG. 10-A
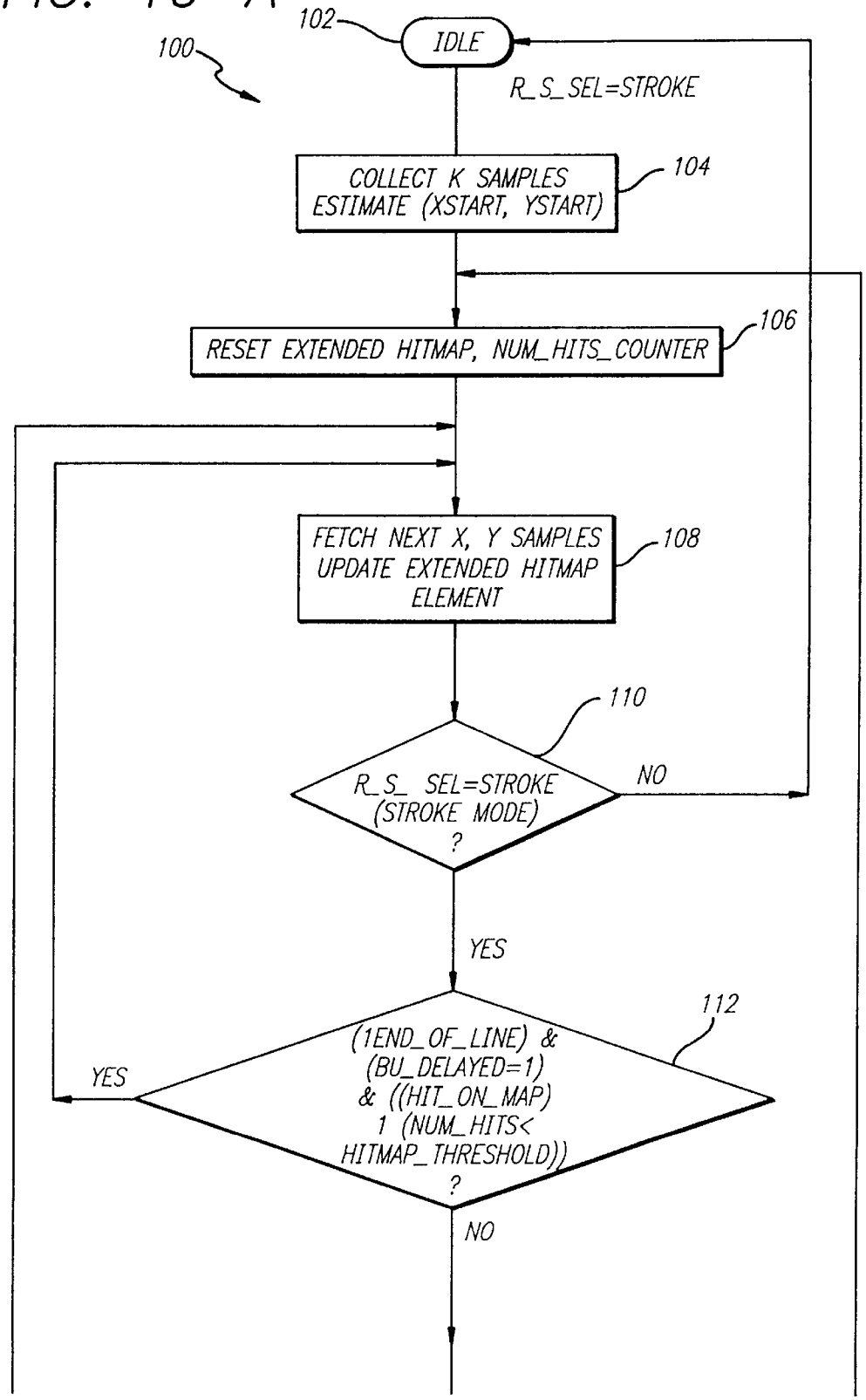

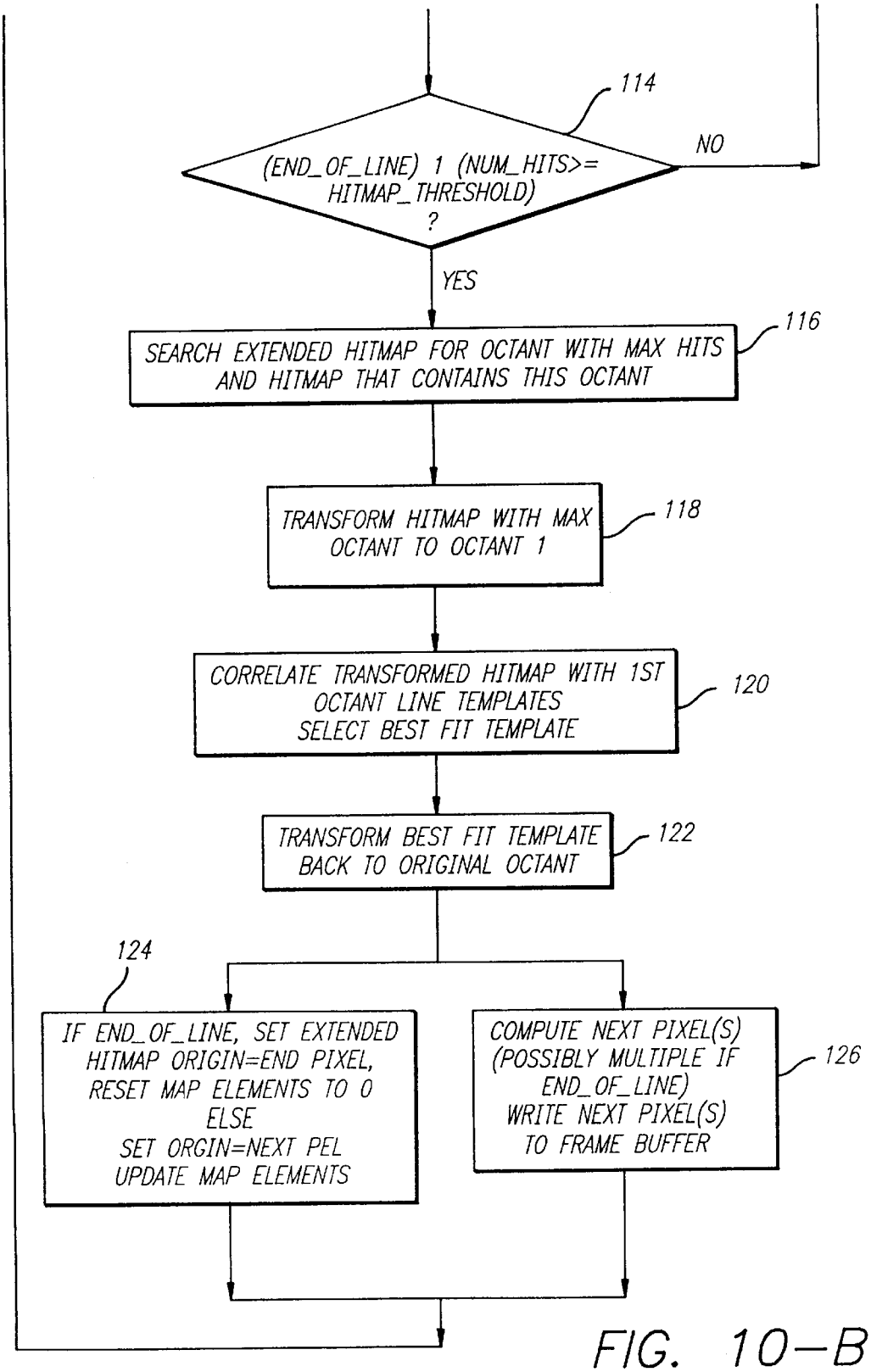
FIG. 10-B

STROKE-TO-STROKE

CROSS-REFERENCE TO RELATED APPLICATION

This application claims the benefit of the priority of Provisional Application No. 60/027,946, filed Oct. 8, 1996.

BACKGROUND OF THE INVENTION

1. Field of the Invention

This invention relates to the display of graphics on rasterized displays such as video monitors, LCD displays and printed pages and, in particular, relates to the conversion of vector or stroke graphic inputs for raster displays.

2. Description of the Related Art

Symbol graphics are conventionally displayed in either a raster scan or vector format on video displays or monitors dedicated to either raster scanned or vector images. Raster displays, such as those on CRT monitors typically used with desktop computers, describe a graphic image by modulating beam intensity while scanning the total display surface in a fixed pattern. In contrast, vector displays move in a random access manner only through those portions of the display surface required to describe the image. Symbols are graphically presented by using a stroke generation system to drive an intensified CRT beam in X and/or Y directions to create lines that may be at any angle and in any direction.

A stroke generation system which can provide high quality symbology graphics in a vector display must have several properties. First, for drawn lines to have uniform intensity, the beam intensity must remain constant, and linear motion in all directions must be at a constant rate. Secondly, due to a time lag in the deflections creating beam motion, the time at which the beam intensity is turned on at the start of a line must be delayed relative to the deflections. Thirdly, since deflections slow down as they approach a constant value, a settling time with the deflection inputs at their final value is required to complete drawing a line-end. Without this "stretch" of intensity at the end of each line, resultant lines will appear shortened and have gaps if chained together.

Analog stroke graphics are a form of vector graphics characterized instantaneously by an X Position, a Y Position, and a Stroke Intensity ("Intensity" or "Bright-Up" (BU)) of the generating beam. As shown in FIG. 1, conventional analog stroke graphics use straight-line vectors and/or arcs. Exemplary straight-line vector V1 has an Intensity (indicated by a bold-face line), a start point V1 Start, an end point V1 End, and a constant slope V1 Slope. Straight-line V2 has a start point V2 Start coinciding with V1 End. Straight-line V3 is unconnected to vector V2. Exemplary arc A1 has an Intensity, a start point A1 Start, an end point A1 End, an initial slope A1 Initial Slope, a plurality of successive gradual changes in slope A1 Slope 1, A1 Slope 2, . . . , (not shown) and an end slope A1 End Slope. An arc can be considered to be a series of small chained vectors each having a slightly different slope. The start point of a line is distinguished by changing the X and Y values with the Intensity at zero (referred to as "slewing"), cutting off the X, Y driver signals and waiting a predetermined interval (referred to as "settling"), and then increasing the Intensity from zero to a positive value. Alternatively, a start point is distinguished by using the end point values of the previous line. An end point is recognized by the Intensity changing from a positive value to zero, or by a positive Intensity with X and Y stationary (indicating settling or that a point is being drawn).

Analog stroke graphics are generated by CRT beam driver signals produced by analog stroke generation systems which generally have the following characteristics:

1) X Position and Y Position are mostly monotonic, while Stroke Intensity may have multiple values but is constant for a given vector. Stroke Intensity may simply indicate the presence or absence of a signal.
2) X and Y are in time synchronization with each other, while Intensity may not be.
3) Beam motion, described by X and Y, is not in a fixed pattern.
4) Symbology is described by vectors and/or arcs drawn in any direction and at any angle.
5) Vectors have a constant slope while arcs have a slowly varying slope.
6) Beam motion is at a constant rate along the direction of a line.
7) Lines may start anywhere on the display surface and are distinguished by the Intensity going from zero to a positive value, or by (X, Y) motion with positive Intensity after detection of an end-of-line condition.
8) A line-end is distinguished by the Intensity going to zero or by a settling time with a non-zero Intensity.
9) The number of times that the beam transits any given point on the display surface can vary from none to many times.

Since raster displays describe graphic images by scanning the total display surface in a fixed pattern, a sequence of randomly located symbols must first be organized into a full frame image before being transmitted to the display. This is usually accomplished in a raster graphics generator by writing an image into an intermediate Frame Buffer (FB) and then transmitting the buffer contents to the display in the required fixed pattern. A conventional FB is organized into fixed pixel locations in an (X, Y) grid with intensity and/or color values assigned to each pixel.

Raster displays require a digitized version of the analog stroke information which if utilized in unprocessed form does not produce acceptable quality graphics because the output violates certain basic norms of raster scanned drawings. In particular, line drawings obtained by simple A/D conversion of stroked vectors violate the Bresenham criteria which specify the rules to be obeyed by a rasterized line produced by the Bresenham line drawing algorithm, which is the generally accepted method for drawing a line on a raster grid. These criteria require that an X-major (slope less than or equal to ±45 degrees with respect to the X-axis) line of unit width must intensify exactly one pixel (pel) per column of the grid, while a Y-major (slope less than or equal to ±45 degrees with respect to the Y-axis) line of unit width must intensify exactly one pixel per row of the grid.

Problems to be resolved in converting analog stroke graphics into raster scanned graphics include:

1) The sequence of randomly located analog symbols must be digitized and organized into a single frame of information.
2) Digitized lines must meet the Bresenham criteria.
3) Unprocessed digitized analog stroke data will almost always produce output that violates the Bresenham criteria, even in the absence of noise.
4) Since the analog X and Y signals are typically noisy, the sequence of intended locations along a line will often be somewhat ambiguous. Consequently, the width of rasterized lines will appear to vary, and their start and end points will be difficult to define.

5) The (X, Y) signals must be resynchronized with the Intensity signal, i.e., compensation must be provided for Intensity stretch and deflection lag.

6) Stroke writing rates are constant along a line for a given application, but will vary from system to system.

7) Sampling must be fast enough in the presence of noise to be able to consistently determine probable intended location, and for static symbology must also be consistent from frame to frame.

8) The number of samples from one FB pixel location to the next is not constant because the distance between illuminated pixels varies with the angle of the line being drawn.

(9) Hardware (HW) and software (SW) operation of stroke generators will vary according to the host platform used.

The simplest method for stroke-to-raster conversion is to digitize analog symbols using an analog-to-digital (A/D) converter, and write the digitized data directly to a raster display Frame Buffer. As noted supra, this approach almost always produces data violating the Bresenham criteria, even in the absence of noise, resulting in a poor quality raster display. An improved conventional method samples over a 2 pel×2 pel ("2×2") window to produce anti-aliased raster output. This approach, which requires sophisticated hardware, produces marginal quality output and in particular makes small characters hard to read.

What is needed is a technique for analog stroke-to-raster conversion which produces real-time output in accordance with accepted standards of high quality raster graphics, in particular the Bresenham criteria. The technique should accommodate tailoring to a variety of stroke generators by implementing straightforward software modifications. The technique should also be robust in the presence of significant noise contamination of stroke data. Moreover, the technique should offer a practical implementation using off-the-shelf devices such as adders, multiplexers and registers, and should be readily scaleable with display surface area.

SUMMARY OF THE INVENTION

The invention provides raster scanned output from vector display input by converting non-Bresenham analog stroke data into Bresenham compliant digitized full-frame images which are stored image-by-image in a frame buffer. The underlying idea is to repetitively match data collected over a preselected spatial window against a limited set of pixel template patterns permitted by the Bresenham criteria, and after each full-frame iteration illuminate the pixels that correspond to the best fitting templates. For each frame, aggregated data from many hit samples over the selected window are matched against the pixel template patterns to determine the pixel providing the best overall fit to the data. Arcs can also be handled by this approach because they are drawn as a set of Bresenham line segments. The window size and choice of pattern templates are determined by practical implementation issues. A moving average start point estimator is used to determine a probable intended start point if the start point is not the end point of a previously drawn line. When drawing lines, the analog (X, Y) inputs are matched to the best approximation of the closest (X, Y) coordinate in a pixel matrix map consistent with probable intended locations as determined by the Bresenham criteria.

In one aspect of the present invention, an improved algorithmic method is provided for converting vector stroke input, such as obtained from active, semi-active or passive detection and tracking of single or multiple targets, into a rasterized display for use with a video monitor or LCD display by collecting digitized stroke addresses within a relatively small, moving analysis window centered at the current (X, Y) location of an analog stroke vector, sampling the digitized addresses at a relatively high rate and evaluating, based on the Bresenham criteria, the instantaneous spatial distribution of hit points sampled within the window to select the pixel most likely to correspond to the next (X, Y) path of the display beam, iteratively repeating the process with the window centered at the address of the last illuminated pixel, and writing the (X, Y) addresses of all such pixels within a frame to a raster display frame buffer.

In another aspect, the invention provides a digital address filter which processes digitized stroke addresses and computes addresses for pixels to be lit on a raster display so that the raster drawing satisfies the Bresenham criteria and does not have gaps between connected vectors. The filter outputs pixel addresses but not the values of pixel attributes (color, intensity), because the values are constant for each vector and are extracted from a stroke prior to processing the stroke locations (X, Y addresses).

In another aspect, the invention provides a vector-to-raster converter for a target display system within a fighter aircraft cockpit.

In still another aspect, the present invention provides a method of converting stroke display data to raster scan display data by illuminating a selected pixel, locating an extended pixel matrix in a fixed relationship to said selected pixel, the stroke display data to count occurrences of sample addresses within said extended pixel matrix and comparing a pattern of sample address counts against a predetermined set of acceptable address patterns to select a subsequent selected pixel.

In a still further aspect, the invention provides a stroke to raster display converter having means for converting an analog input data stream to a stream of digital pixel addresses, an extended pixel matrix of pixel address counters, means for sampling the stroke display data to count occurrences of sample addresses within the extended pixel matrix, means for comparing a pattern of sample address counts against a predetermined set of acceptable address patterns to select a subsequent selected pixel and means for illuminating subsequent selected pixel.

These and other features and advantages of the invention will become further apparent from the detailed description and accompanying figures that follow. In the figures and description, numerals indicate the various features of the invention, like numerals referring to like features throughout both the drawings and description.

BRIEF DESCRIPTION OF THE DRAWINGS

FIG. 9 is a functional block diagram of a digital address filter using the FIG. 2 pipeline.

FIG. 10 is a functional flowchart for the FIG. 9 filter.

DETAILED DESCRIPTION OF THE INVENTION

Figure 1:
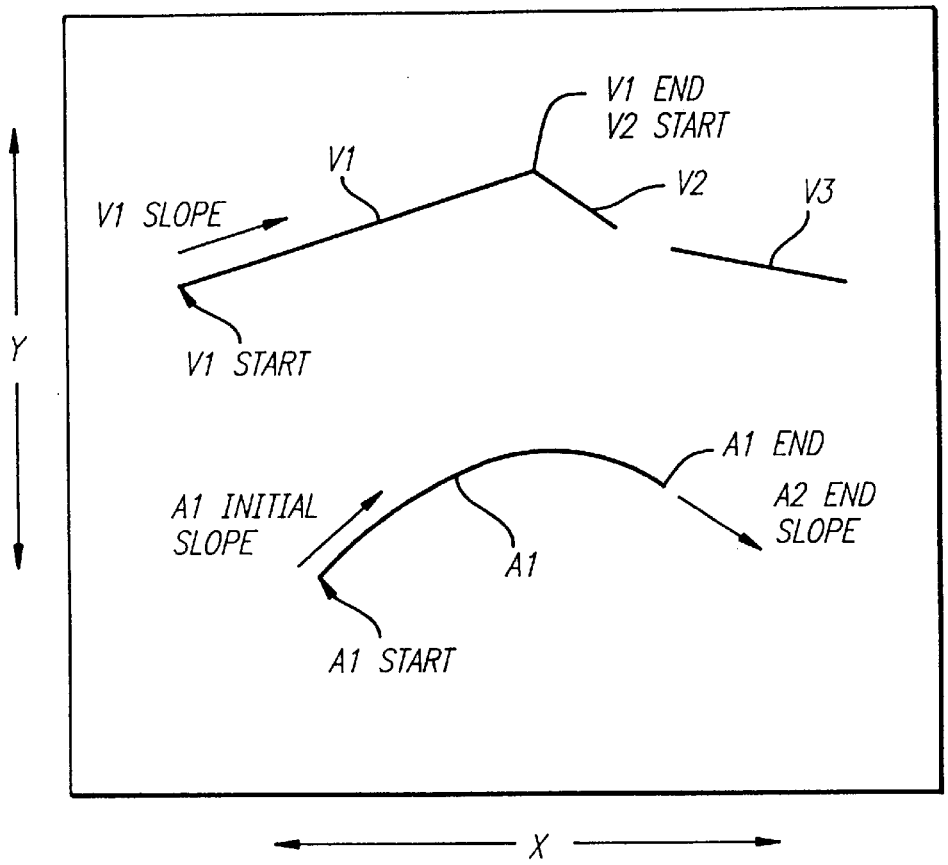
FIG. 1 PRIOR ART
FIG. 1 shows three straight-line vectors and an arc exemplifying lines commonly used in conventional analog stroke graphics displays.

While the present invention is open to various modifications and alternative constructions, the embodiments shown in the drawings will be described herein in detail. It is to be understood, however, there is no intention to limit the invention to the particular forms disclosed. On the contrary, it is intended that the invention cover all modifications, equivalencies and alternative constructions falling within the spirit and scope of the invention as expressed in the appended claims.

Figure 3A:
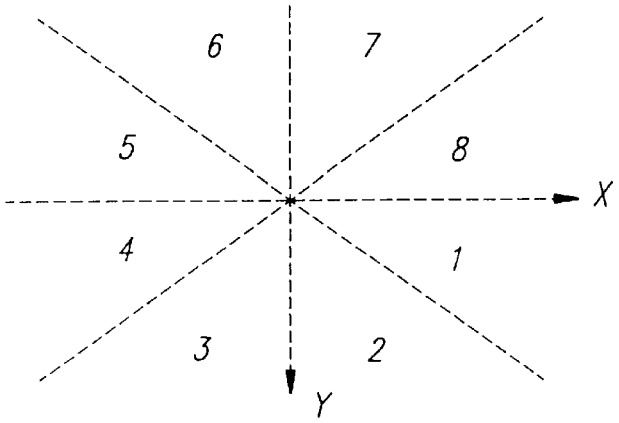
FIG. 3(*a*)–(*c*) are graphical representations of the convention used to label octants on a vector display, an extended hitmap having an active grid divided into overlapping sub-grid hitmaps, and locations of sampled hit data elements in the FIG. 3(*b*) first sub-grid hitmap which occur in the FIG. 3(*a*) first octant.
Figure 2:
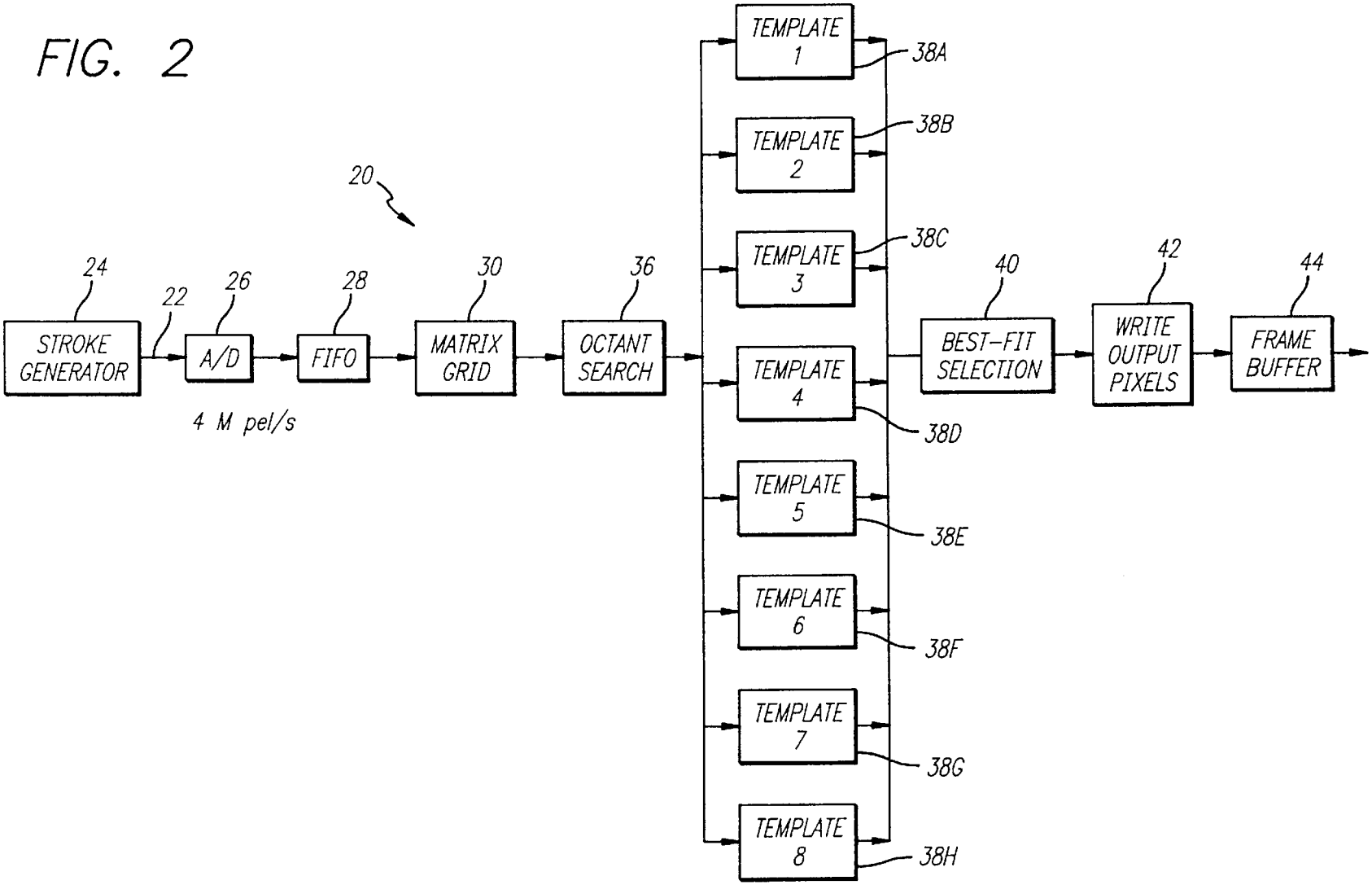
FIG. 2 shows a data processing pipeline according to a first embodiment of the present invention.
Figure 3B:
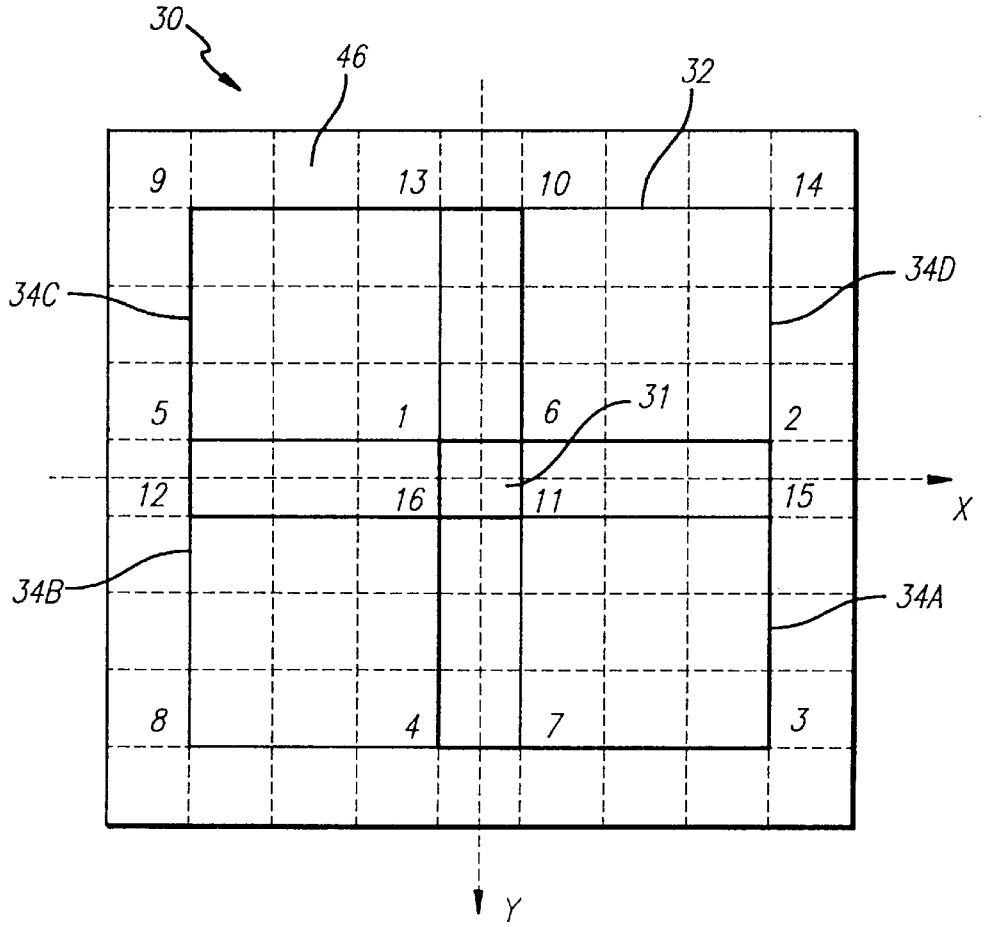
Figure 3C:
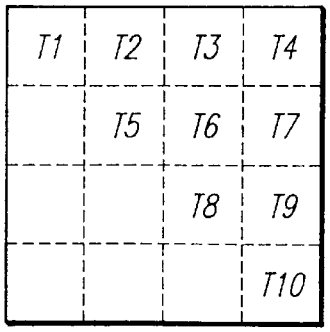

Referring to FIG. 2, in a first aspect of the present invention a data processing pipeline 20 using an iterative processing algorithm operates on a data stream 22 (typically at 4 million pel/sec) of analog stroke addresses produced by a vector stroke generator 24 which are digitized by and stored in A/D circuitry 26 as first-in/first-out (FIFO) digital data 28. Samples of the digitized stroke address data 28 are collected in an M×M pixel matrix grid 30 referred to as an "extended hitmap" 30. As shown in FIG. 3(*b*), extended hitmap 30 has origin 31 which corresponds to the current instantaneous (X, Y) position of a point on a stroke line or arc. Extended hitmap 30 includes an N×N pixel "active area" 32 which is a subset of extended hitmap 30 and has the same center, origin 31. Active area 32 is divided into four overlapping P×P pixel sub-grids 34A, 34B, 34C and 34D referred to as "hitmaps." A radial coordinate system divided into octants (see FIG. 3(*a*)) is superimposed on each hitmap. Referring again to FIG. 2, a search 36 is performed to identify the hitmap containing the octant that collected the largest number of "hits", i.e., sampled data elements. The hitmap having the largest number of hits is correlated against a plurality of grid templates each of which represents a possible pixel pattern allowed by the Bresenham criteria. For example, where each hitmap 34A–34D is a 4×4 grid, eight grid templates, 38A, 38B, 38C, 38D, 38E, 38F, 38G, 38H, are required. A best-fit selection 40 of the template having the highest correlation with the hitmap having the largest number of data hits determines the location of a pixel which is written to a frame buffer 44. The written pixel becomes the origin for the next iteration of pipeline 20. Thus, the center of extended hitmap 30, origin 31, corresponds to the 'current' stroke point position and is the last pixel location that was written out to frame buffer 44.

Because each P×P hitmap contains $2^{P-1}$ possible Bresenham patterns per octant, there are $2^{P+2}$ possible patterns in the active area, of which eight are duplicates due to overlaps between hitmaps. Thus, there are $(2^{P+2}-8)$ unique Bresenham patterns in the (2P−1×2P−1) active area containing the four P×P hitmaps.

Referring now to FIG. 3(*b*), in the currently preferred embodiment of the present invention, M=9, N=7, and P=4. Data 28 are collected in a 9 pixel×9 pixel extended hitmap 30 having a 7 pixel×7 pixel active area 32. Active area 32 has an equal number of pixels in all four coordinate directions (X, −X, Y, −Y) and is divided into four overlapping 4×4 hitmaps 34A, 34B, 34C, 34D. Each hitmap is oriented to include origin 31 in a corner. There are eight Bresenham patterns per octant, for a total of 64 patterns, of which 56 are unique. In FIG. 3(*b*) indicia denote the corners of active area 32 and hitmaps 34A—34D. Thus, active area 32 is bounded by indicia 9-14-3-8-9, hitmap 34A is bounded by indicia 1-2-3-4-1, hitmap 34B is bounded by indicia 5-6-7-8-5, hitmap 34C is bounded by indicia 9-10-11-12-9, and hitmap 34D is bounded by indicia 13-14-15-16-13.

Each pixel location ("element") in active area 32 is associated with a counter that is incremented when an incoming digitized sample 'hits' it. As shown schematically in FIG. 3(*c*) for hitmap 34A, incoming samples T1, T2, . . . T10are registered in appropriate locations in a 4×4 hitmap in active area 32. Sample collection continues until one of two "exit criteria" conditions is satisfied. Condition 1, termed 'hit_off_grid', is met when active area 32 contains at least as many hits as specified by a software parameter hitmap_threshold, which is the minimum number of samples required in active area 32 before processing can begin, and the latest hit is not in active area 32. Condition 1 corresponds to the stroke beam moving off the 7×7 active area, implying that all samples that can be used to decide which pixel to light next have been collected. The hitmap_threshold parameter is used to provide immunity from noise bursts that might cause a few samples to be off active area 32 even though the beam is still on it. The parameter also prevents active area 32 from being processed with too few samples. Condition 2, termed 'end_of_line', is satisfied when any location in active area 32 has collected more samples than a SW programmable threshold, endpel_threshold, which is the number of hits at a single location of active area 32 that indicates this location is a stroke end point. The rationale is that this threshold could not have been reached at the same (X, Y) location unless the beam had stopped moving. Once either exit criterion is met, active area 32 of extended hitmap 30 is available to the processing pipeline 20 for identification of the next pixel location to be lit.

Inactive portion 46 of extended hitmap 30 surrounding active area 32 is provided as a buffer to capture samples arriving during clock cycles when active area 32 is being processed. A buffer is needed around the active area because the beam is expected to be at the edge of active area 32 when enough samples have been collected for processing, so hits occurring then are likely to be in the buffer area (except for certain noisy hits that are off the grid and are lost).

Figures 4A, 4B:
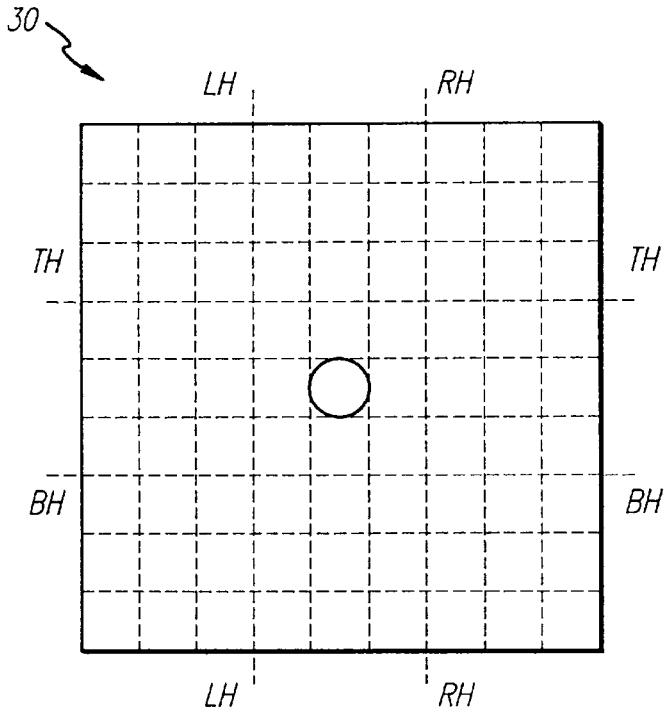
FIG. 4(*a*)–(*b*) graphically represent the rules for updating sampled hit elements when the FIG. 3(*b*) extended hitmap is moved to a new origin.
Figure 5A:
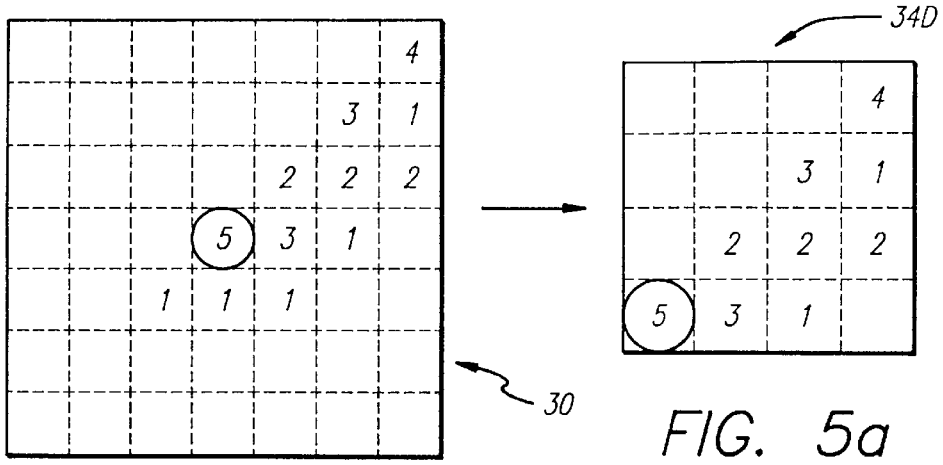
FIG. 5(*a*)–(*d*) graphically depict the steps in a normal iteration of the FIG. 2 algorithmic method.
Figure 5B:
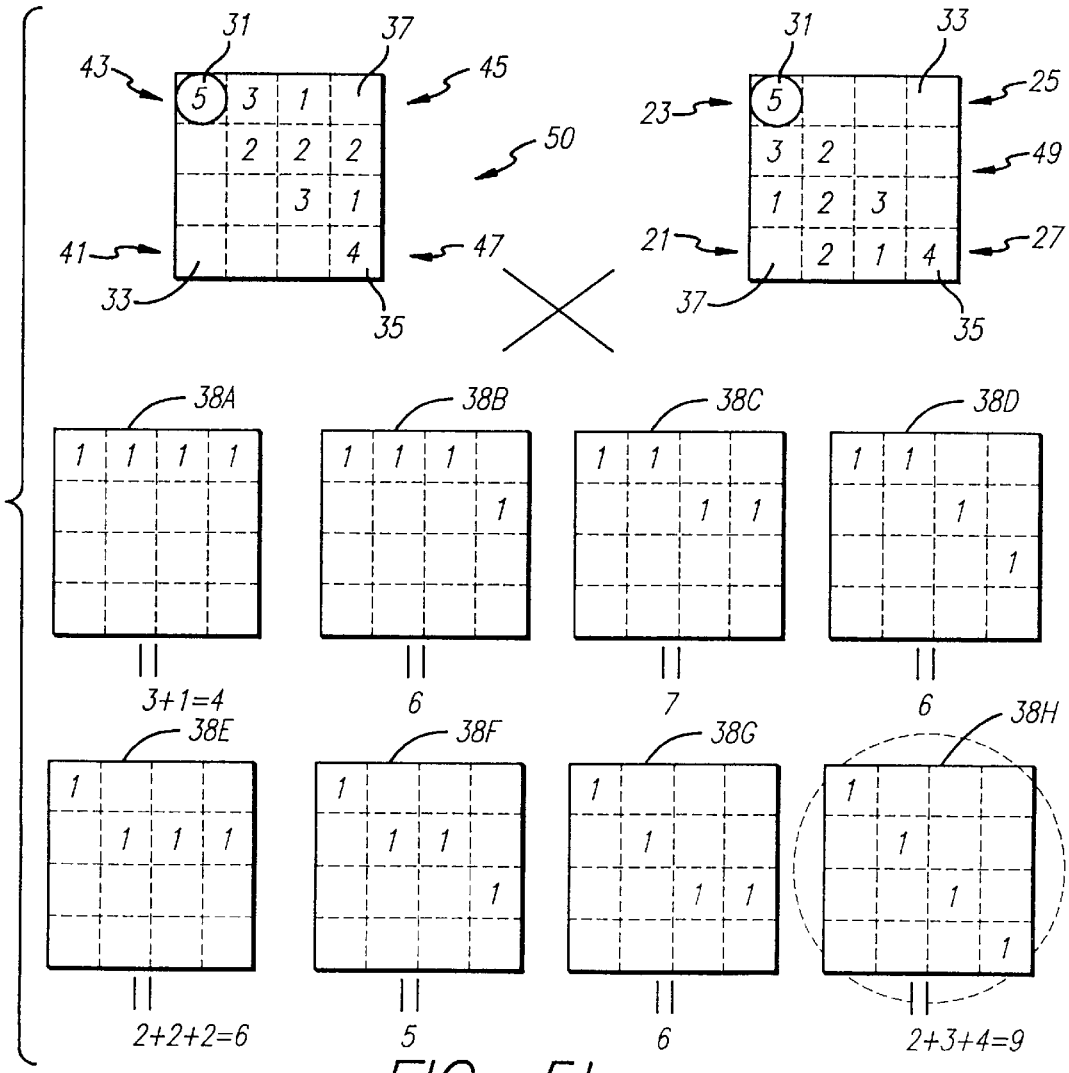
Figure 5C:
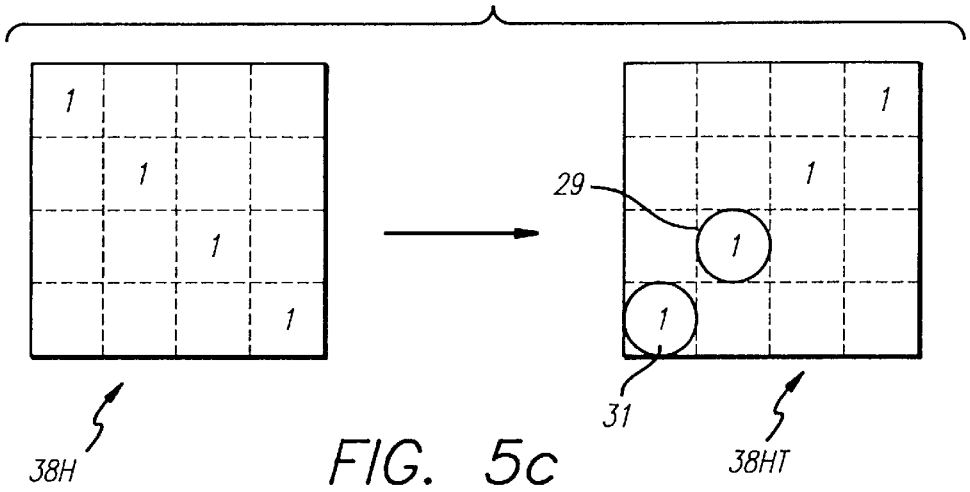
Figure 5D:
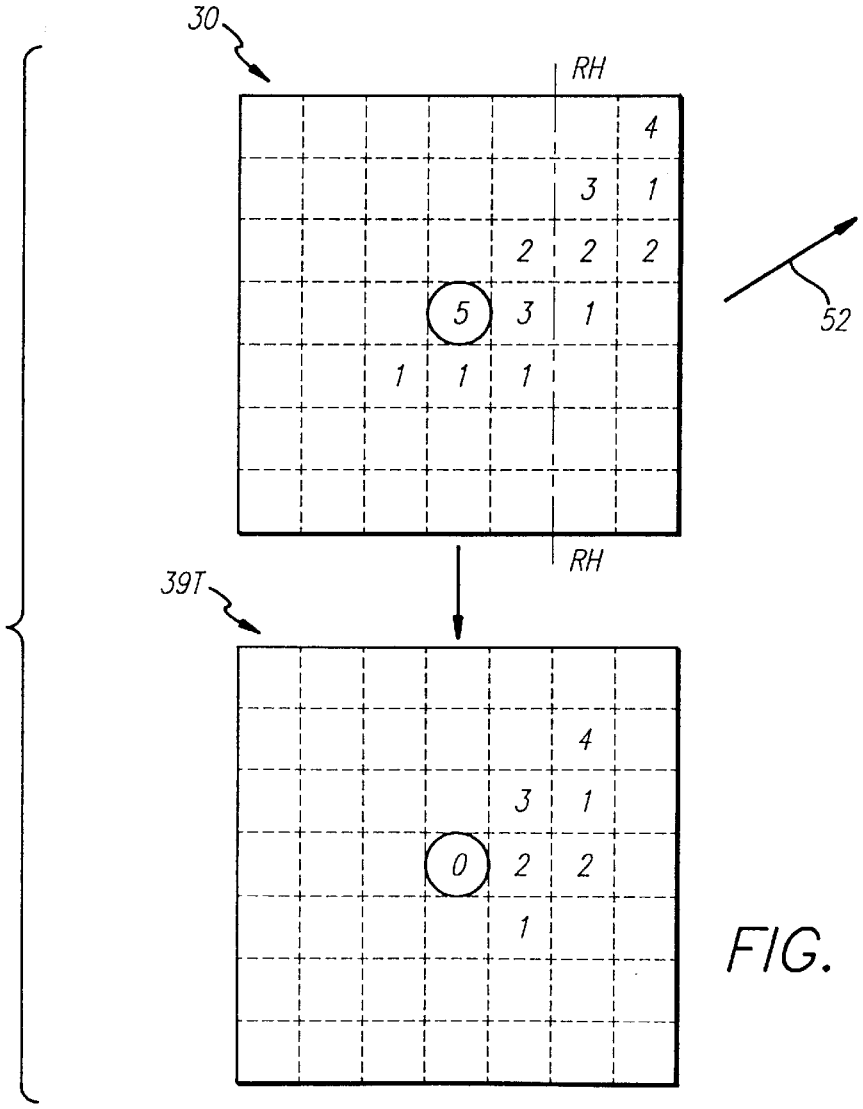
Figure 6A:
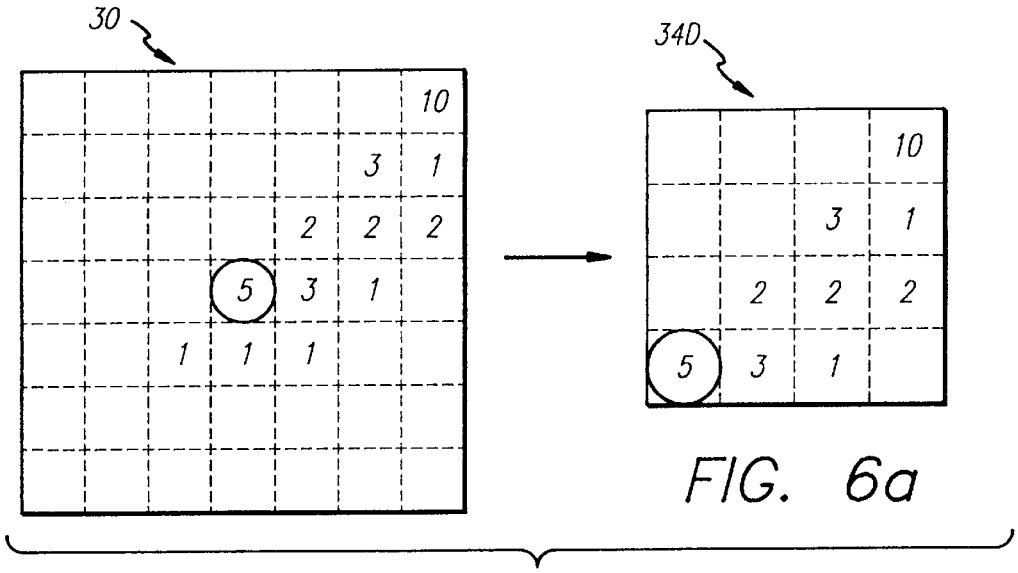
FIG. 6(*a*)–(*d*) graphically depict the steps in an iteration of the FIG. 2 algorithmic method when the number of hits in a FIG. 3(*b*) hitmap location exceeds a threshold value signifying that a vector end point has been reached.
Figure 6B:
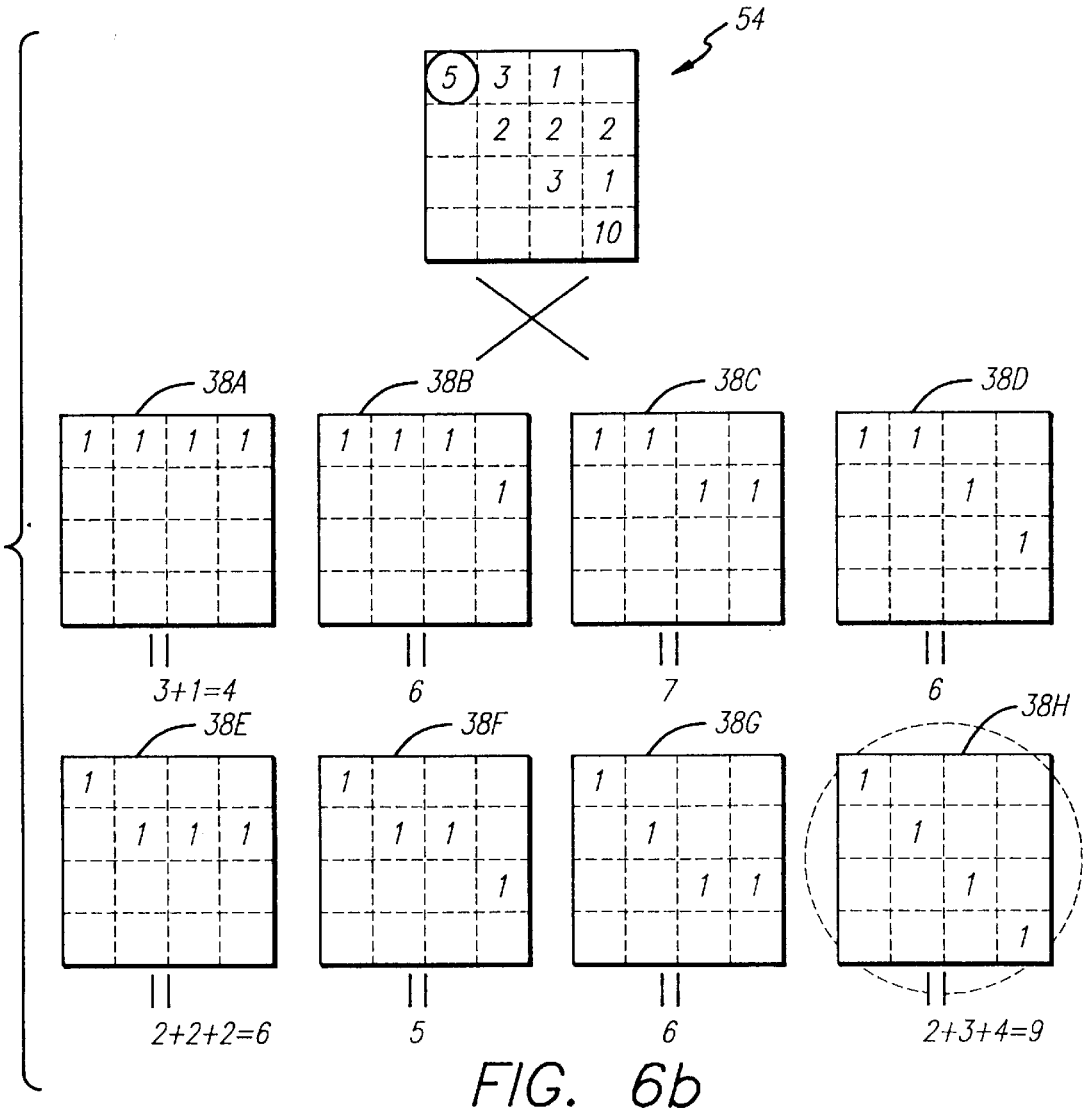
Figure 6C:
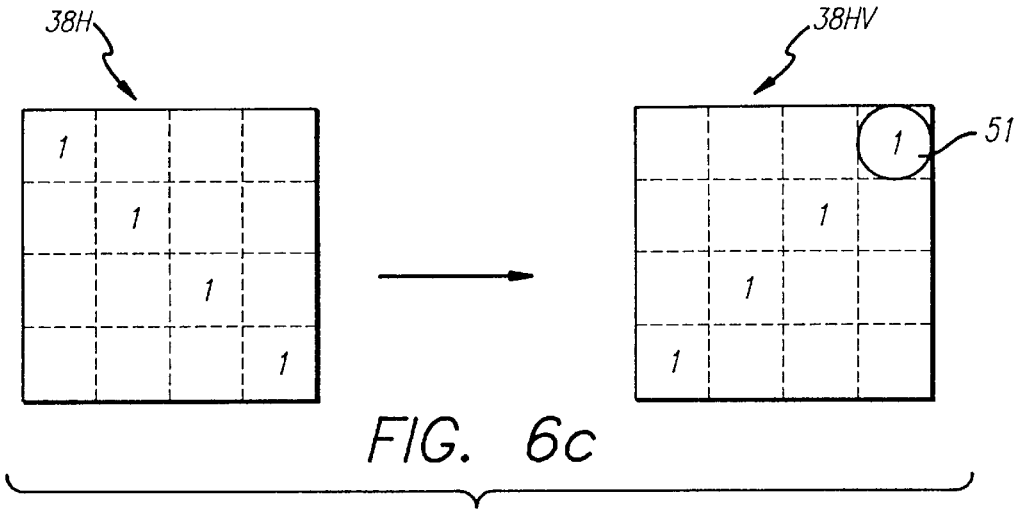
Figure 6D:
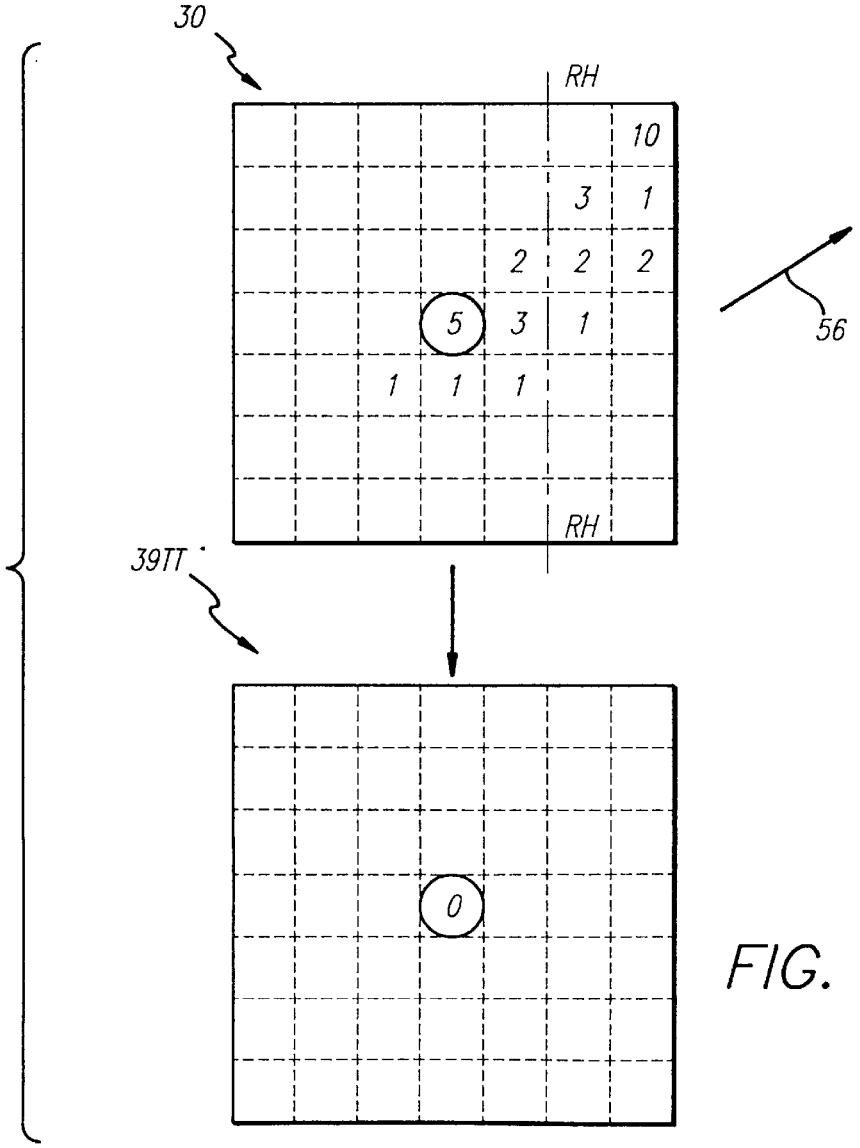

When pipeline 20 produces an (X, Y) offset required to move extended hitmap 30 to a new origin corresponding to the next pixel written out to frame buffer 44, all extended hitmap element counters are updated. Hitmap origin translation is accomplished by shifting counter values in a direction opposite to the direction of translation. Counters for elements relevant to the next processing iteration are updated according to this shift and all other counters are reset to zero. FIGS. 4(*a*) and 4(*b*) depict the updating technique of the currently preferred embodiment of the present invention which require each element in extended hitmap 30 to have data path connectivity with some of its eight nearest neighbors. In FIG. 4(*a*), the circled element denotes the current origin and indicia LH, RH, TH and BH denote, respectively, left, right, top, and bottom half-planes. Elements to be saved are determined according to their relationship with one of the half-planes. Other techniques for determining which elements of extended hitmap 30 are to be saved or to be cleared may be used with suitable results.

FIGS. 5(*a*)–(*d*) show steps consecutively executed by processing pipeline 20 during a "normal" iteration resulting in determining a single pixel address and sending a 'write' instruction to the raster display frame buffer 44. Processing begins when Condition 1 or Condition 2 is met. Active area 32 of extended hitmap 30 is loaded into registers in pipeline 20, leaving extended hitmap 30 free to record new data. Referring now to FIG. 5(*a*), pipeline 20 identifies which 4×4 sub-grid hitmap of active area 32, whose current origin (X, Y) is denoted by the circled element, contains the octant that collected the largest number of hit samples. This requires summing the counter value of the elements in each octant and comparing the sums to find the largest. Octant 1 is found to have five hits, octants 2 and 3 two hits each, octant 4 one hit, octants 5 and 6 no hits, octant 7 nine hits, and octant 8 eighteen hits. Octant 8 and hitmap 34D therefore are selected.

Referring now to FIG. 5(*b*), selected hitmap 34D is 'transformed' into a 4×4 hitmap 50 by changing hitmap locations to map selected octant 8 into octant 1. In general, even numbered octants are transformed by rotating them into the position of octant 2, and then inverting all elements of the hitmap such that the upper right element becomes the lower left element, and the lower left element becomes the upper right element. In this example, hitmap 34D is rotated 90° clockwise about origin 31 to become hitmap 49. Next, all elements of hitmap 49 are changed to hitmap 50 such that origin 31 moves from upper left corner 23 to upper left corner 43, element 33 moves from upper right corner 25 to lower left corner 41, element 35 moves from lower right corner 27 to lower right corner 47, and element 37 moves from lower left corner 21 to upper right corner 45. For odd number octants 7,3,and 5, the only change necessary to map into octant 1 requires rotating the hitmap containing the selected octant clockwise about origin 31 +90°, −90° and 180° respectively. Hitmap 50 is then correlated against the eight 4×4 templates 38A, 38B, 38C, 38D, 38E, 38F, 38G, 38H, each representing one of eight possible first octant pixel patterns allowed by the Bresenham criteria. Template 38H is found to have the highest correlation with hitmap 50. Referring now to FIG. 5(*c*), template 38H is transformed back into octant 8 as template 38HT by reversing the steps described above. Template 38HT provides the next pixel, at location 29 (X+1, Y−1), written to frame buffer 44. Correlation can be implemented using only additions because correlation between a template such as template 38H and hitmap 50 is simply the addition of the three locations in the hitmap that correspond to '1's in the template. The '1' at origin 31 is common to all templates and can be ignored. Only one pixel is written out per iteration through the pipeline. The pixel location that has been selected as the 'next' pixel becomes the new origin of the extended hitmap 30. Referring now to FIG. 5D, the values of element counters in active area 32 and the other pixels in extended hitmap 30 are shifted according to the location of the new origin, location 29, with respect to old origin 31 when extended hitmap 30 is translated in the direction indicated by arrow 52, resulting in translated area 39T. Portions of the extended hitmap that contain 'old' data are reset to zero. A variety of techniques may be used to clear out the old data, for example, counters of grid elements that lie in the vertical half-plane (for X-major lines) or horizontal half-plane (for Y-major lines) located at the new origin are considered to contain 'new' data because they represent samples that arrived after determination of the current pixel and are therefore allowed to retain their counter values.

After the origin and element counter values of extended hitmap 30 are updated, the hitmap is ready to continue processing new stroke data. During the entire time taken for processing and updating hitmap locations, data samples arriving in extended hitmap 30 are recorded but end up in buffer zone elements if the noise level is low.

The above description refers to a normal iteration of the pipeline 20 which results in a single pixel address and a write instruction for that address sent to frame buffer 44. A singular case occurs when the number of hits in any location in active area 32 equals or exceeds a software programmable parameter, endpel_threshold, which represents a number of hits at one location so large as to be impossible unless the beam has stopped moving. That is, such a point must represent an end point of the current vector. If endpel_threshold is encountered when checking active area 32 for the two exit criteria, pipeline 20 processes the hitmap in the same way as described above with the following exceptions: all pixels in the best matching template up to and including the pixel that represents the end point are written to frame buffer 44; all locations in extended hitmap 30 are reset; and the new origin is the end point found. In such cases, one, two, three, or more pixels may be written to frame buffer 44, depending on where the end pixel is located in the template. FIGS. 6(*a*), 6(*b*), 6(*c*), 6(*d*) show an example that results in writing out three pixels. Referring now to FIG. 6(*a*), 7×7 pixel active area 32 has a current origin 31 (X, Y) denoted by the circled element, and endpel_threshold is set at 10. Ten is the number of hits in element (row 1, column 7) so the element must be a vector end point. Performing the octant search 36, octant 1 is found to have five hits, octants 2 and 3 two hits each, octant 4 one hit, octants 5 and 6 no hits, octant 7 fifteen hits, and octant 8 twenty-four hits. Thus, the selected 4×4 hitmap is again hitmap 34D which contains octant 8. Referring now to FIG. 6(*b*), hitmap 34D is transformed into a 4×4 hitmap 54 by mapping octant 8 into octant 1 as described above, and hitmap 54 is correlated against the eight templates 38A, 38B, 38C, 38D, 38E, 38F, 38G, 38H. Template 38H is found to be the best match to hitmap 54. Referring now to FIG. 6(*c*), template 38H is transformed back into octant 8 (38HU), and three pixels (X+1, Y−1), (X+2, Y−2), (X+3, Y−3) are written to frame buffer 44 until end pixel 51 at position (row 1, column 4) is reached. Referring now to FIG. 6(*d*), the origin is translated in a direction denoted by arrow 56 from (X, Y) to (X+3, Y−3) and all counter values are reset to zero, as shown in transformed area 39TT. The new origin is now at end pixel 51.

Figure 7:
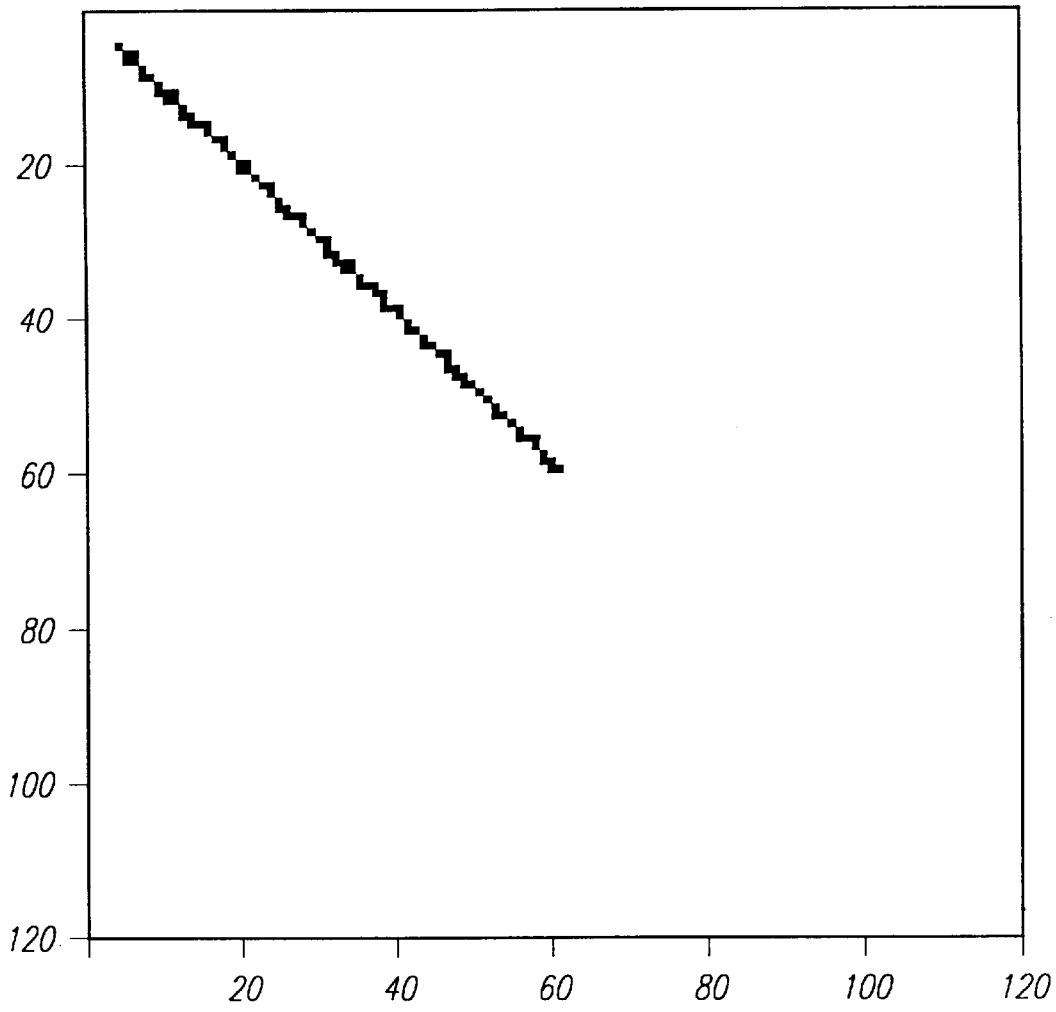
FIG. 7 is a simulated rasterized graphic image of a 45 degree line with gaussian noise, when unprocessed digitized stroke data are input to the raster display Frame Buffer.
Figure 8:
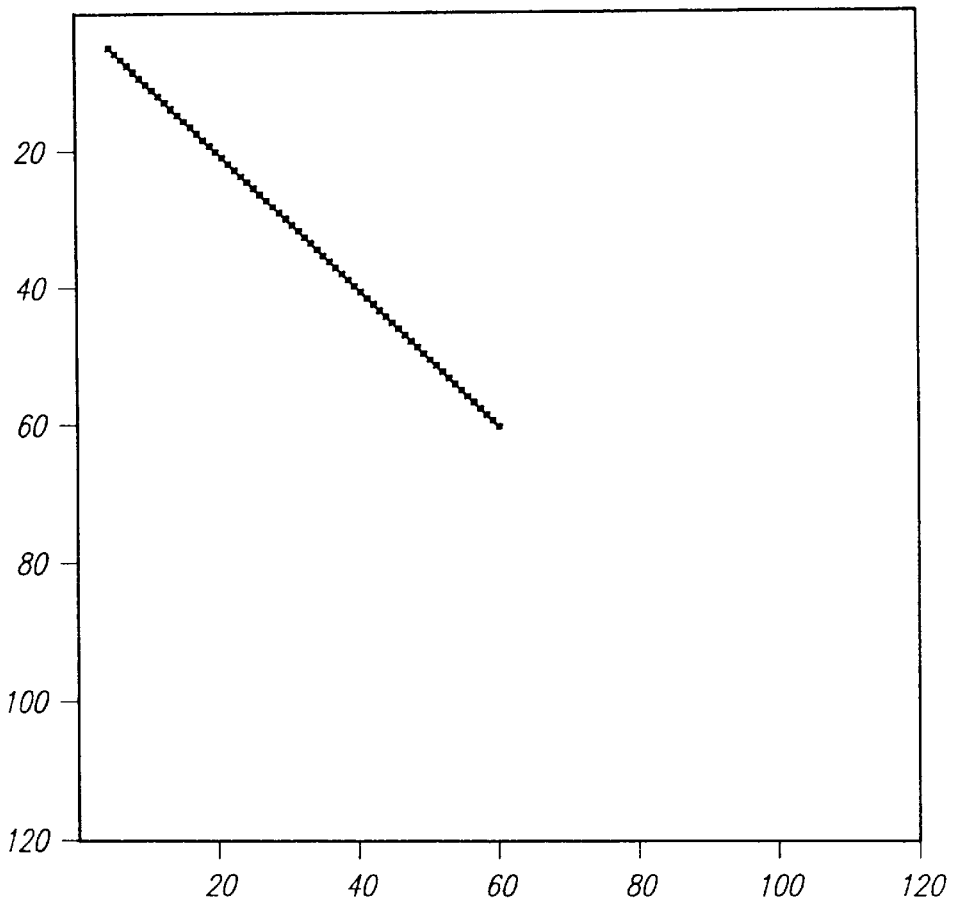
FIG. 8 shows the FIG. 7 image when digitized stroke data are processed according to the FIG. 2 processing pipeline.

FIGS. 7 and 8 show the difference in graphics quality obtained when unprocessed digitized stroke data are input directly to the raster display frame buffer 44, compared to when the data are first processed in pipeline 20. The comparison is for a simulated 45 degree line to which gaussian white noise has been added. Referring to FIG. 7, use of unprocessed stroke data results in a line whose apparent width varies along its length and which clearly violates the Bresenham criteria. Referring to FIG. 8, processing in pipeline 20 results in a perfect Bresenham line that lights up exactly one pixel per column.

Referring to FIG. 9, a functional block diagram of the present invention is shown. Analog stroke vector-to-raster scan converter, converter 162 implements processing pipeline 20, and includes analog converter 62, hitmap control 176, extended hitmap block 134, motion control 182, and output pixel generator 186. The blocks are chosen by logical partitioning of functions rather than by physical necessity of grouping circuits together in separate physical entities.

Analog converter 62 includes a plurality of A/D converters 129, 130, and 131 which receive hit signal inputs via cable 164. FIFOs 132 and 133 are included to delay the digitized position data to eliminate the bright-up delay which occurs at the beginning and end of stroke vectors. Digitized (X, Y) data is transferred via path 174 to hitmap control 176.

Hitmap control 176 includes threshold evaluator 80, and off-map detector 82 for the software programmable parameters hitmap_threshold and endpel_threshold, respectively. Hitmap control 176 controls converter 162, and in particular controls state devices that coordinate the processing steps of pipeline 20. Hit register select 177 includes logic that maintains and updates the coordinates of the current origin of extended hitmap 30 and subtracts them from the coordinates of incoming hits to generate offsets in X and Y that represent hit locations in extended hitmap 30.

Start Position Evaluator 64 includes a selectable parameter K which is the number of samples used for start point estimation. Typical K values are 2, 4, 8 or 16. Moving average start point estimator stores the last K samples of the stroke addresses and uses them to maintain an estimate of the (X, Y) coordinates of the start point of a stroke. This position corresponds to the initial origin of extended hitmap 30. The estimated start point coordinates at clock cycle n are generated by the following equations for a standard moving average estimator known in the digital signal processing literature.

$$x(n) = \frac{1}{K}\sum_{i=1}^{K} x(n-i)$$

$$y(n) = \frac{1}{K}\sum_{i=1}^{K} y(n-i)$$

These equations are implemented using storage elements (registers), adders and shifters.

Extended hitmap block 134 includes a plurality of counters RR1, . . . RRM×M corresponding one-to-one with elements in the M×M extended hitmap 30, and a plurality of active area registers AR1, . . . ARN×N that are updated with the values of elements in the N×N active area 32 on every cycle except when an exit criteria is met and processing begins. Active area register values are held constant while processing occurs in pipeline 20, but extended hitmap 30 continues to be updated with hits that arrive during the processing period thus stroke data comparison is a dynamic event rather than an off-line activity. When a new (X, Y) origin for extended hitmap 30 becomes available at the end of a processing cycle and the hitmap is translated, the value of each element register is shifted to account for the change in origin, as described supra.

Data from active area registers AR1 through AR N×N are input via a path 180 to motion controller 182 which includes logic that adds the register values in each octant of active area 32 and selects the octant with the largest number of hits. Octant selector 183 selects the sub-grid hitmap containing the maximum octant and transforms it to the first octant. Best fit selector 184 correlates the transformed hitmap with a plurality of templates TT1, TT2, TT3, . . . , TTJ stored in pattern library 181. Template Correlator 181 includes ($2^{P-1}$) templates, which are 38A, 38B, 38C, 38D, 38E, 38F, 38G, 38H in the displayed embodiment. Correlation is performed by adding values in appropriate locations in the hitmap. Referring again to FIG. 5(*b*), each correlation consists of adding the three '1' locations, but excluding the top-left element common to all templates. Using the notation defined in FIG. 3(*c*), eight correlation operators cor1, cor2, . . . cor8 are given by cor1=T2+T3+T4
cor2=T2+T3+T7
cor3=T2+T6+T7
cor4=T2+T6+T9
cor5=T5+T6+T7
cor6=T5+T6+T9
cor7=T5+T8+T9
cor8=T5+T8+T10.

These operators are easily implemented using adders, and their outputs are fed into best fit selector 184 which outputs a "best-fit" number in the range 1 to 8, corresponding to the index of the operator having the largest output. This number is then input to output pixel generator 186.

Position change control 185 includes logic that takes the best-fit template number from best fit selector 184 and octant information from octant selector 183 and generates (X, Y) offsets which are applied to data shift/clear control 179 to shift the origin of extended hitmap 30 to a new location corresponding to the next pixel that will be written out to frame buffer 187. After shifting origin 31, data shift/clear control 179 clears portions of extended hitmap 30 as discussed with respect to FIGS. 4(*a*) and (*b*).

Output pixel generator 186 implements step 42 of pipeline 20 which writes pixels to frame buffer 187. Step 42 uses the current origin coordinates from current origin pointer 175 and the (X, Y) offsets for the new origin in generating a write cycle to write a pixel to frame buffer 187 for the new origin. If Condition 2, end_of_line, is detected, output pixel generator 186 writes one or more pixels until an end pixel has been reached and written out. XY address generator 188 converts current origin pointer 175 to a memory address, and intensity generator 189 determines the proper intensity value to store and frame buffer 187 stores a rasterized image of the analog stroke vector image. Frame buffer 187 is connected to monitor 166 via cable 168.

FIG. 10 shows a functional flow diagram 100 for the operations performed by converter 162. The filter starts from an idle state 102 when input signal R_S_sel=stroke. When stroke mode is selected, converter 162 performs stroke to raster conversion. Operation 104 collects K samples and estimates an initial origin ($X_{start}$, $Y_{start}$) for extended hitmap 30. Operation 106 reinitializes extended hitmap 30 and resets num_hits_counter. Next, an operation 108 collects the next incoming hit samples and updates each element counter in extended hitmap 30. An operation 110 tests flag R_S_sel=stroke. If NO, the filter returns to the idle state 102; if YES, a test is performed on incoming data at an operation 112 to determine if Condition 2 has not been met and if brightness data is positive and if condition 1 has not been met. If YES, the filter returns to operation 108; if NO, a test is performed at an operation 114 to determine if sufficient data hits have been recorded to perform a valid stroke to raster conversion. If NO, the filter returns to operation 106; if YES, an operation 116 searches extended hitmap 30 to find the octant with the greatest number of hits and the 4×4 hitmap containing this octant. An operation 118 transforms the selected 4×4 hitmap into an octant 1 representation. An operation 120 then correlates the transformed hitmap with the candidate templates and selects the best-fit template. An operation 122 transforms the best-fit template back into the original octant. An operation 124 tests whether Condition 2 has been met. If NO, the origin of extended hitmap 30 is set at the next pixel, and hitmap element counters are updated; if YES, the origin is set to an end pixel and all hitmap element counters are reset to zero. If Condition 2 is not met, an operation 126 writes the next pixel to frame buffer 44; if Condition 2 is met, operation 126 writes pixels until reaching an end pixel. The filter then returns to operation 108 to collect more hit samples.

Operation 112 relates to a FIFO (X, Y) and a FIFO Bright-Up pointer which are offset by a SW programmable parameter set according to the observed or measured delay between the BU and deflection signals. Therefore, hit data processed in pipeline 20 must be adjusted to remove the BU delay. Pipeline 20 is only in operation when the delay compensated BU signal is active. When the BU signal goes inactive, the pipeline completes processing the current data and then stops. The output drawing rate (in pel/sec) must be equal to or greater than the input rate, i.e., the drawing rate of stroke generator 24.

Practical considerations dictate the choice of extended hitmap and sub-grid hitmap size, in particular the size of the integrated circuit available for implementation. As a general rule, the larger the hitmap the smoother the output will be because more pixels can be lit up per unit length of stroke. However, because the number of Bresenham patterns increases exponentially with hitmap size, the number of templates and correlation operators also increase exponentially. Hitmaps that are 4 pixels×4 pixels are preferred for an implementation using a large field programmable gate array (FPGA) or application specific integrated circuit (ASIC). As discussed supra, a 4×4 hitmap results in eight Bresenham templates per octant, and fifty-six unique templates over the eight octants. Referring again to FIGS. 5 (*b*) and 6(*b*), the algorithmic step transforming the selected 4×4 hitmap into the first octant prior to correlating with the templates is done solely as a practical approach to identifying the best-fit template. If the hitmap were correlated with the templates without doing this transformation, fifty-six correlation operators would be required (one for each of the unique Bresenham patterns). By transforming to the first octant, the number of correlation operators is reduced to eight.

Figure 11:
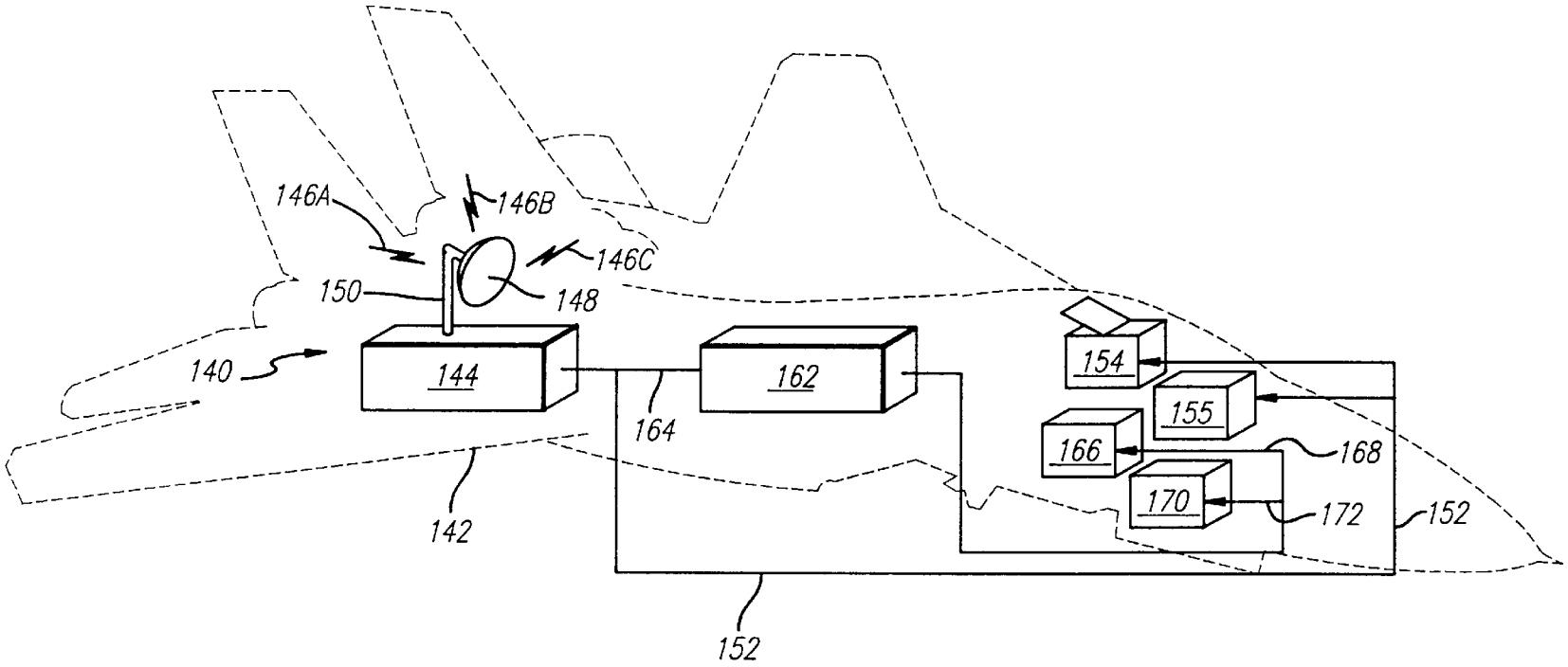
FIG. 11 is a conceptual block diagram of a target display system in a fighter aircraft cockpit according to the present invention.

The present invention may be used in a target display system in a fighter aircraft. FIG. 11 shows target display system 140 in a fighter aircraft 142 which includes an targeting display system 144 which creates vector tracks in response to active, semi-active or passive radiation "hits" 146A, 146B, 146C, . . . detected by a sensor 148 connected to targeting display system 144 via a cable 150. Targeting display system 144 outputs track data via a cable 152 directly to a heads-up display 154 and video and vector CRT monitor 155. In a third embodiment of the present invention target display system 140 includes an analog stroke vector-to-raster scan converter, converter 162. Targeting display system 144 is connected to analog stroke vector-to-raster scan converter 162 via a cable 164. Digitized stroke graphics generated by the converter are input frame-by-frame to a raster scanned CRT monitor 166 via a cable 168, or alternatively to matrix display 170 via a cable 172. Matrix display 170 may be any matrix display technology including LCD, EL, etc.

Figure 12:
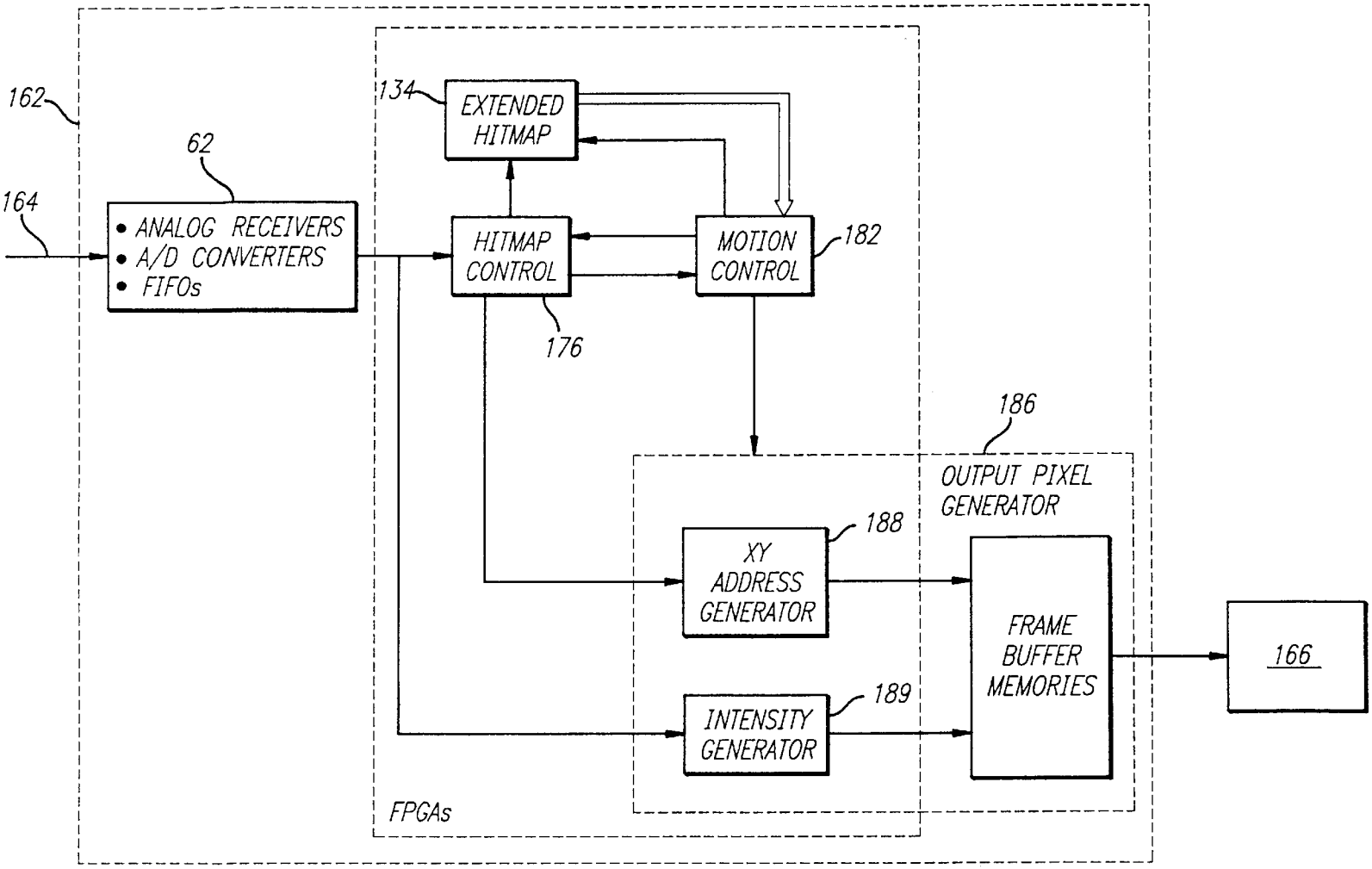
FIG. 12 is a block diagram of a digital address filter according to the present invention.

Referring to FIG. 12, converter 162 includes parameters which can be adjusted by SW programming to accommodate a broad range of stroke generators which differ in their drawing rates and characteristics. In another embodiment of the present invention, Analog converter 62 is composed of analog receivers, analog to digital converters and FIFOs. All of the digital circuitry is contained within one or more FPGA chips. This includes hitmap control 178, extended hitmap 134, motion control 182, and XY generator 188 and intensity generator 189 of output pixel generator 186. Converter 162 has been implemented using FPGAs which support writing rates up to 8 MHz (eight display increments (DI) per sec) for a variety of different aircraft cockpit platforms. In this embodiment, converter 162 is robust in the sense that a typical implementation can handle sample noise with an average deviation (error) of ±2–3 pixels and occasional noise bursts with much larger deviation. The basic architecture can be implemented to provide noise immunity up to any desired average deviation with the usual tradeoff between robustness and additional silicon area. The algorithmic pipeline 20 can be scaled up or down to trade off silicon area and performance.

What is claimed is:

1. A method of converting stroke display data to raster scan display data comprising the following steps:

writing a selected pixel to a frame buffer;

locating an extended pixel matrix in a fixed relationship to said selected pixel;

sampling stroke display data to count occurrences of sample addresses within said extended pixel matrix; and comparing a pattern of sample address counts against a predetermined set of acceptable address patterns to select a pixel to be a next selected pixel.

2. The method of claim 1 further comprising the step of:

repeating the preceding steps until a stroke segment end is detected, or raster mode is selected.

3. The method of claim 2 wherein:

the steps are done in real-time.

4. The method of claim 3 or claim 2 further comprising the step of:

monitoring the count of occurrences of sample addresses in the extended pixel matrix during sampling to determine when to begin comparing.

5. The method of claim 4 wherein the step of monitoring the count of occurrences of sample addresses in the extended pixel matrix during sampling further comprises the step of:

determining to begin comparing when the total sample address count in the pixel matrix reaches a first predetermined level or when a stroke segment end is detected.

6. The method of claim 5 wherein the step of determining to begin comparing when a stroke segment end is detected further comprises the step of:

monitoring the count of occurrences of sample addresses in a series of subsets of the extended pixel matrix.

7. The method of claim 6 wherein the step of determining to begin comparing when a stroke segment end is detected comprises the step of:

determining to begin comparing when the total count of occurrences of sample addresses in one of the series subsets of the extended pixel matrix reaches a second predetermined level.

8. The method of claim 7 wherein each subset is a pixel.

9. The method of claim 7 wherein the step of comparing a pattern of sample address counts against a predetermined set of acceptable address patterns to select a pixel to be the next selected pixel further comprises the steps of:

selecting an acceptable address pattern having the closest density match to said pattern of sample address counts; and writing every pixel of said acceptable address pattern to said frame buffer.

10. The method of claim 9 further comprising the steps of:

clearing sample data from the extended pixel matrix; and selecting a selected pixel to define the extended pixel matrix based on a preselected number of sample addresses.

11. The method of claim 4 further comprising the steps of:

locating an active pixel matrix in a fixed relationship to said selected pixel, such that said active pixel matrix contains a subset of extended pixel matrix sample addresses;

storing a sample address count for sample addresses within said active pixel matrix; and comparing a pattern of sample address counts within said active pixel matrix against a predetermined set of acceptable address patterns to select a pixel to be a next selected pixel.

12. The method of claim 11 wherein the step of comparing said pattern of sample address counts within said active pixel matrix against a predetermined set of acceptable address patterns further comprises the step of:

analyzing the magnitude of sample address counts in said active pixel matrix to select a selected subset of said active pixel matrix to be compared against said predetermined set of acceptable address patterns.

13. The method of claim 12 wherein the step of analyzing the sample density in the active pixel matrix to select a selected subset further comprises the step of:

selecting said selected subset having the greatest magnitude of sample address counts.

14. The method of claim 13 wherein the step of selecting said selected subset having the greatest density further comprises the steps of:

analyzing sub-portions of each subset to determine which sub-portion or sub-portions have the greatest magnitude of sample address counts; and selecting a selected subset including a sub-portion or sub-portions having the greatest magnitude of sample address counts.

15. The method of claim 12 wherein the step of comparing said pattern of sample address counts against a predetermined set of acceptable address patterns further comprises the step of:

transforming said selected subset of said active pixel matrix relative to said set of acceptable address patterns to reduce the comparing required.

16. The method of claim 15 wherein the step of comparing said pattern of sample address counts against a predetermined set of acceptable address patterns further comprises the step of:

selecting an acceptable address pattern having the closest density match to said selected subset.

17. The method of claim 16 wherein the step of selecting a subsequent selected pixel further comprises the step of:

retransforming said selected acceptable address pattern to match the original orientation of said selected subset or said selected hitmap.

18. The method of claim 17 wherein the step of selecting a pixel to be a next selected pixel further comprises the steps of:

selecting said next selected pixel to be a pixel of said acceptable address pattern adjacent to the selected pixel to which the extended pixel matrix and the active pixel matrix are related.

19. The method of claim 18 wherein the step of selecting a pixel to be the next selected pixel further comprises the step of:

clearing sample data from a portion of the extended pixel matrix and the active pixel matrix, based on the next selected pixel.

20. The method of claim 12 wherein the subset of the active pixel matrix comprises:

a hitmap of the active pixel matrix such that said hitmap includes said selected pixel.

21. The method of claim 20 wherein the step of analyzing said magnitude of sample address counts in said active pixel matrix to select a hitmap further comprises the step of:

selecting said hitmap having the greatest magnitude of sample address counts.

22. The method of claim 21 wherein the step of selecting said hitmap having the greatest density further comprises the steps of:

analyzing octants of said active pixel matrix to determine an octant or octants having the greatest magnitude of sample address counts; and selecting a selected hitmap of said active pixel matrix including said octant or octants having the greatest magnitude of sample address counts.

23. The method of claim 22 wherein the step of comparing said pattern of sample address counts against a predetermined set of acceptable address patterns further comprises the step of:

transforming said selected hitmap relative to said set of acceptable address patterns to reduce the comparing required.

24. The method of claim 23 wherein the step of comparing said pattern of sample address counts against a predetermined set of acceptable address patterns further comprises the step of:

selecting an acceptable address pattern having the closest pattern match to said selected hitmap.

25. The method of claim 24 wherein the step of selecting a subsequent selected pixel further comprises the step of:

retransforming said selected acceptable address pattern to match the original orientation of said selected subset or said selected hitmap.

26. The method of claim 25 wherein the step of selecting a pixel to be a next selected pixel further comprises the steps of:

selecting said next selected pixel to be a pixel of said acceptable address pattern adjacent to the selected pixel to which the extended pixel matrix and the active pixel matrix are related.

27. The method of claim 26 wherein the step of selecting a pixel to be the next selected pixel further comprises the step of:

clearing sample data from a portion of the extended pixel matrix and the active pixel matrix, based on the next selected pixel.

28. The method of claim 11 wherein the step of monitoring the sample address count in the extended pixel matrix during sampling to determine when to begin comparing further comprises the step of:

copying said pattern of sample address counts from said extended pixel matrix to said active area pixel matrix prior to beginning comparing.

29. The method of claim 1 further comprising the step of:

selecting a selected pixel to define the extended pixel matrix based on a preselected number of sample addresses.

30. A stroke to raster display converter comprising:

means for converting an analog input data stream to a stream of digital pixel addresses;

an extended pixel matrix of pixel address counters;

means for sampling the stroke display data to count occurrences of sample addresses within said extended pixel matrix;

means for comparing a pattern of sample address counts against a predetermined set of acceptable address patterns to select a subsequent selected pixel;

raster frame buffer for storing each subsequent selected pixel; and means for illuminating said subsequent selected pixels in said raster frame buffer.

31. The device of claim 30 further comprising:

means for monitoring the sample address count in the extended pixel matrix during sampling to determine when to begin comparing.

32. The device of claim 31 further comprising:

means for monitoring the sample address count in a series of subsets of the extended pixel matrix.

33. The device of claim 32 further comprising:

means for determining to begin comparing when the total sample address count in one of the series subsets of the extended pixel matrix reaches a second predetermined level.

34. The device of claim 31 further comprising:

an active pixel matrix of data registers in a fixed relationship to said selected pixel, such that said active pixel matrix contains fewer sample addresses than said extended pixel matrix; and means for comparing a pattern of sample address counts within said active pixel matrix registers against a predetermined set of acceptable address patterns to select a subsequent selected pixel.

35. The device of claim 34 further comprising:

means for analyzing the magnitude of sample address counts in said active pixel matrix to select a selected subset of said active pixel matrix to be compared against said predetermined set of acceptable address patterns.

36. The device of claim 35 further comprising:

means for selecting said selected subset having the greatest magnitude of sample address counts.

37. The device of claim 36 further comprising:

means for analyzing sub-portions of each subset to determine which sub-portion or sub-portions have the greatest magnitude of sample address counts; and means for selecting a selected subset including a sub-portion or sub-portions having the greatest magnitude of sample address counts.

38. The device of claim 37 further comprising:

means for transforming said selected subset of said active pixel matrix relative to said set of acceptable address patterns to reduce the comparing required.

39. The device of claim 38 further comprising:

means for selecting an acceptable address pattern having the closest density match to said selected subset.

40. The device of claim 31 further comprising:

means for clearing sample data from a portion of the extended pixel matrix and the active pixel matrix, based on the subsequent selected pixel.

41. The device of claim 31 further comprising:

means for selecting a selected pixel to define the extended pixel matrix based on a preselected number of sample addresses.

* * * * *